United States Patent [19]

Wallace

[11] 4,071,092

[45] Jan. 31, 1978

[54] PNEUMATIC SCREWDRIVER WITH TORQUE RESPONSIVE SHUT-OFF

[75] Inventor: William K. Wallace, Barneveld, N.Y.

[73] Assignee: Chicago Pneumatic Tool Company, New York, N.Y.

[21] Appl. No.: 775,766

[22] Filed: Mar. 9, 1977

[51] Int. Cl.[2] ..... B25B 23/14

[52] U.S. Cl. ..... 173/12; 192/150

[58] Field of Search ..... 81/52.4 R, 52.4 A; 91/59; 173/12; 192/56 R, 150

[56] References Cited

U.S. PATENT DOCUMENTS

| | | | |
|---|---|---|---|
| 2,964,151 | 12/1960 | Eckman | 173/12 X |
| 3,275,116 | 9/1966 | Martin | 173/12 X |
| 3,477,521 | 11/1969 | Kiester et al. | 173/12 |
| 3,612,236 | 10/1971 | Fernstrom et al. | 192/56 R |
| 3,766,990 | 10/1973 | Eckman et al. | 173/12 |
| 3,811,513 | 5/1974 | Wezel et al. | 173/12 |
| 3,993,145 | 11/1976 | Findeli | 173/12 |
| 4,006,785 | 2/1977 | Roll et al. | 173/12 |

*Primary Examiner*—Lawrence J. Staab
*Attorney, Agent, or Firm*—Stephen J. Rudy

[57] ABSTRACT

A pneumatically powered tool for setting of threaded fasteners, having an axially movable clutch assembly and a fastener drive spindle both of which are coupled for rotary motion to effect fastener run-up. Upon attainment of a predetermined torque load on the drive spindle, the clutch assembly and drive spindle are intermittently uncoupled by action of a ball being forced up a cam ramp, whereupon a latch pin is activated to initiate seating of an air inlet valve, thus terminating tool operation.

7 Claims, 7 Drawing Figures

PNEUMATIC SCREWDRIVER WITH TORQUE RESPONSIVE SHUT-OFF

BACKGROUND OF THE INVENTION

The art of torque control for automatic shut-off of pneumatically powered hand held tools, is well developed and many differing designs have been proposed and utilized for attainment of the desired objective.

A type of tool having automatically operable torque shut-off means is found in U.S. Pat. No. 3,667,345, which tool incorporates a pneumatically balanced air flow control valve. Another type, using a centrifugally responsive ball valve, is disclosed in U.S. Pat No. 3,850,553. A family of tools, utilizing a push rod operable at a predetermined torque to close an air inlet valve, can be found in U.S. Pat. Nos. 2,743,635, 2,964,151, 3,059,620, 3,195,704, 3,276,525, 3,477,521 and 3,766,990. The tool of the present invention is of the last mentioned type; however, it incorporates a structural arrangement which provides advantages over known devices of the prior art.

More specifically, the device of the present invention incorporates a ball which is forced up a cam ramp when predetermined torque is realized, resulting in movement of a latch pin to cause closing of an inlet valve. In those devices using a sear, or the equivalent, a secondary camming action is required to move the sear to valve closing position. Depending upon job conditions and tool tolerances, it is possible for the sear to operate before predetermined torque is realized, thus resulting in error in torque shut-off objective. Furthermore, it is possible for the sear to cause valve closing operation when balls, or the equivalent, of an operative cam are at the crest of a cam, and if such a condition occurred, the tool could not automatically reset. Such a malfunction is avoided in the cam ramp and ball arrangement employed in the present invention, and in addition, ease of manufacture because of reduced tolerance requirements, contributes to lower manufacturing costs without sacrifice of tool operating efficiency.

DESCRIPTION OF PREFERRED EMBODIMENT

Figure 1:
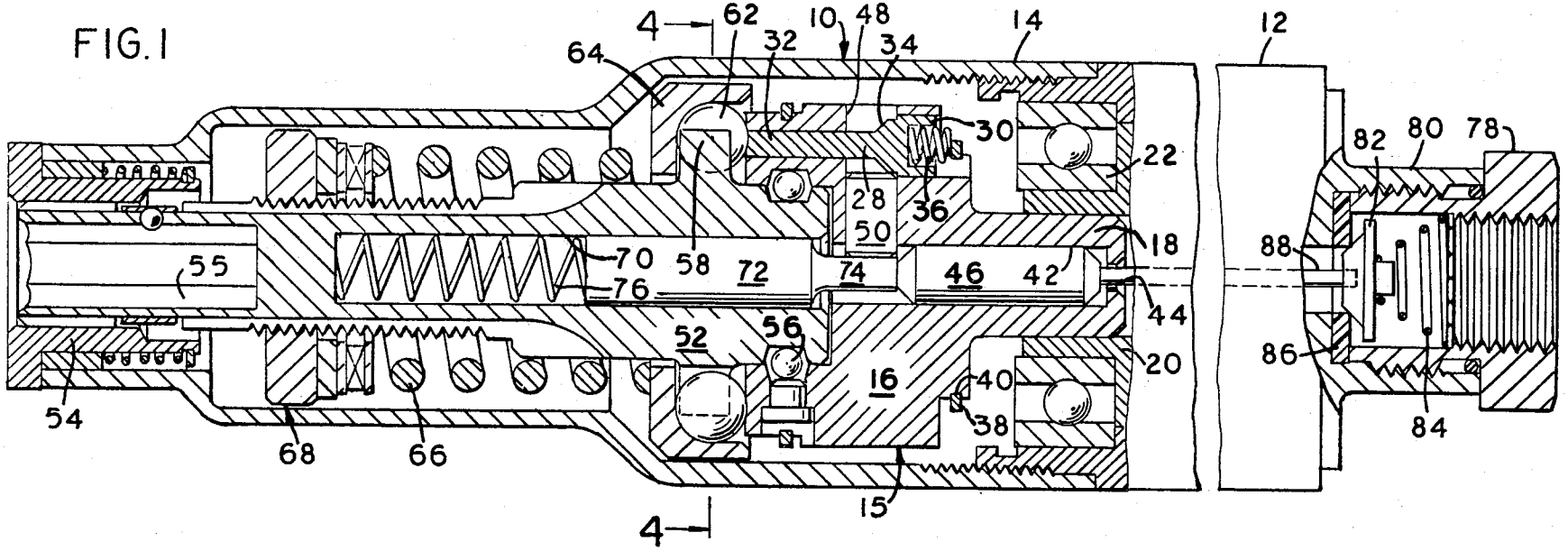
FIG. 1 is a longitudinal fragmented section view of a tool embodying the principles of the invention, illustrating the position of various parts of the tool prior to being applied to a fastener.

Referring now to the drawings, numeral 10 indicates a fastener setting tool embodying the principles of the invention, the illustration being foreshortened to satisfy drawing space requirements, the portion omitted being a vane type pneumatic motor as used in such tools and well known in the art. The tool includes a motor housing 12 to which is threadedly affixed a clutch housing 14.

A clutch assemblage 15, positioned in the clutch housing 14, includes a jaw clutch 16, the rear portion having a hexagonal protrusion 18 supported for rotary movement by a conventional gearing assemblage arranged in the motor housing, a portion 20 of the gearing assemblage being shown. Bearing means 22, mounted in the motor housing, are provided for rotational support of the gearing assembly portion 20. The forward portion of the jaw clutch 16 has a plurality of teeth 24 providing cam pockets, each formed with a ball ramp 26. A latch pin 28 is slidably arranged in the jaw clutch 16, the axis of the pin paralleling the axis of the jaw chuck. The latch pin has an enlarged head portion 30 and an elongated body portion 32 with a conical cam surface 34 provided between the two portions. The end of the elongated body portion 32 is arranged to project from the surface of a ball ramp 26. A conical spring 36 is compressively enclosed in the head portion 30 of the latch pin, and held therein by a snap ring 38 positioned in a groove 40 formed in the body of the jaw clutch 16. In such manner, the latch pin is always biased toward the front, or jaw end of the clutch.

The jaw clutch 16 is formed with an axial bore 42 enclosed in the rear end and has a push rod hole 44 formed in the enclosure. A cylindrical rod 46, slidably arranged in the bore 42, has tapered ends, the forward end serving as a cam surface for tool cut-off operation, as later described herein. The jaw clutch has a radial hole 48 opening into the bore 42 and slidably enclosing a cylindrical lock pin 50 which engages the latch pin 28.

A drive spindle 52, located in the clutch housing 14, has a rearward end rotatably supported in the jaw clutch 16, and the forward end in a movable sleeve 54 located in the reduced diameter front end of the clutch housing. A hexagonal bore 55 is provided in the front end of the spindle for receipt of a tool bit shank (not shown) for driving any type of fastener commonly used, the bit shank being removably retained in the spindle by a quick release ball lock means, a known expedient in the art.

Figure 4:
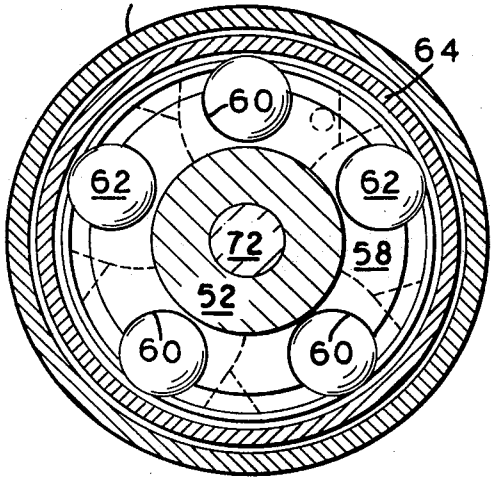
FIG. 4 is a section view as seen from line 4—4 in FIG. 1.

Ball bearings 56, located in complementary raceways formed in the spindle 52 and the jaw clutch 16, provide rolling contact therebetween. The spindle 52 is formed with a circular flange 58, provided with a plurality of ball pockets 60 (FIG. 4) each of which has a ball 62 maintained therein. A cup-like member, or ball retainer 64, engages the balls and maintains them in engagement with the clutch cam pockets. Helical spring 66, is compressively arranged between the ball retainer and an adjusting nut assemblage 68, which can be axially positionable upon the spindle by virtue of a threaded connection therewith.

The drive spindle 52 is provided with an axial bore 70, enclosed at the forward end, in which is slidably arranged a reset pin 72. Pin 72 has a reduced diameter portion 74 at its rear end which is constantly urged into abutment with the rod 46 by virtue of a compressed helical spring 76 located in the forward end of the bore 70. The reduced diameter portion 74 serves at a seat for the lock pin 50, the axial length of the lock pin being equal to the distance between the pin portion 74 and the head portion 30 of the latch pin 28 for simultaneous engagement with each respective portion.

An air inlet bushing 78, threadedly secured to a nipple portion 80 formed on the rear wall of the motor housing 12, encloses a disc valve 82 which is urged by a conical spring 84 into seating engagement with a seal 86, the latter preferably being made of a synthetic rubber material. Unseating of the valve 82 allows pressurized pneumatic medium from a hose (not shown) to flow into the tool motor for rotational operation, all in a well known manner. A push rod 88 is affixed at one end to the disc valve 82, the length of the rod being such as to allow entry of rod into the push rod hole 44 when movable parts of the tool are in the FIG. 1 position. Compressive force of conical spring 84 is greater than that of the helical spring 76.

It will be apparent that the clutch jaw tooth arrangement illustrated will cause clockwise rotation of the clutch assemblage and the spindle for run-up and setting of the workpiece.

OPERATION OF PREFERRED EMBODIMENT

Figure 5:
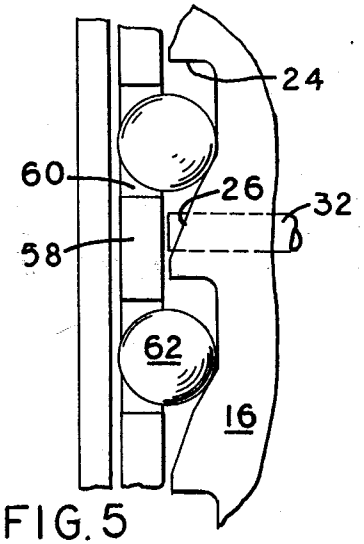

FIGS. 1 and 5 illustrate the position of the movable elements of the tool when the latter is in non-operative condition, i.e., prior to the tool being applied to a work piece, e.g., threaded fastener, for run-up thereof. It will be noted that the valve 82 is seated, and that lock pin 50 is in engagement with the head portion 30 of the latch pin 28, as well as with the reduced diameter portion 74 of the reset pin 72.

Figure 2:
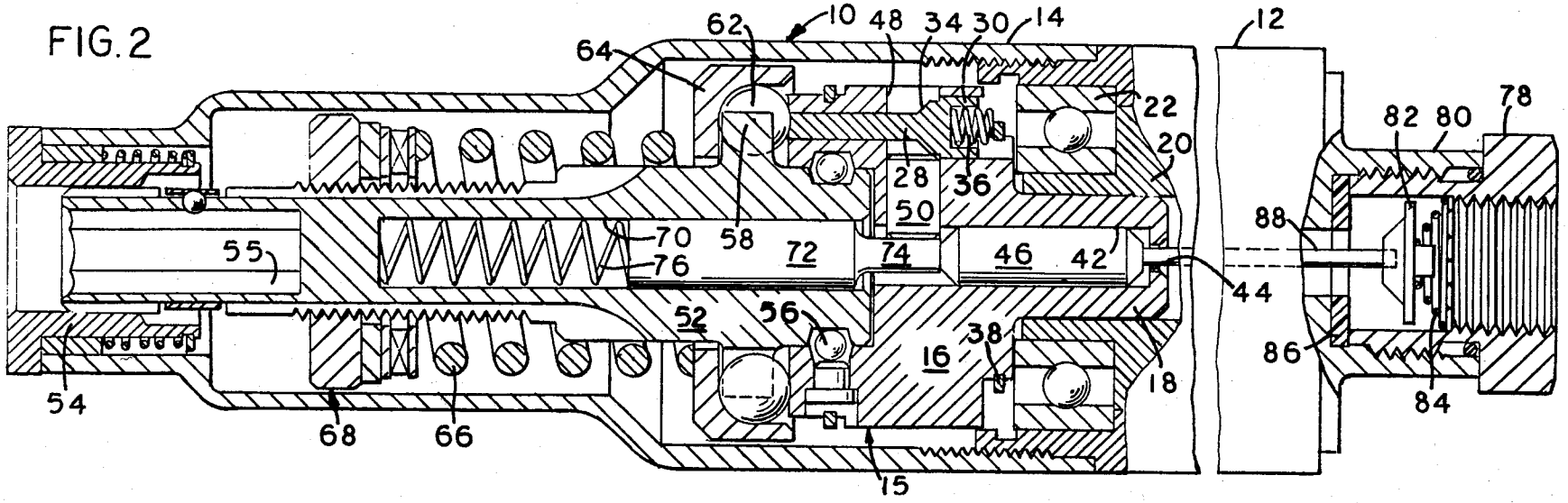
FIG. 2 is the same but showing the position of various parts of the tool during run-up of a fastener being driven by the tool.
Figure 3:
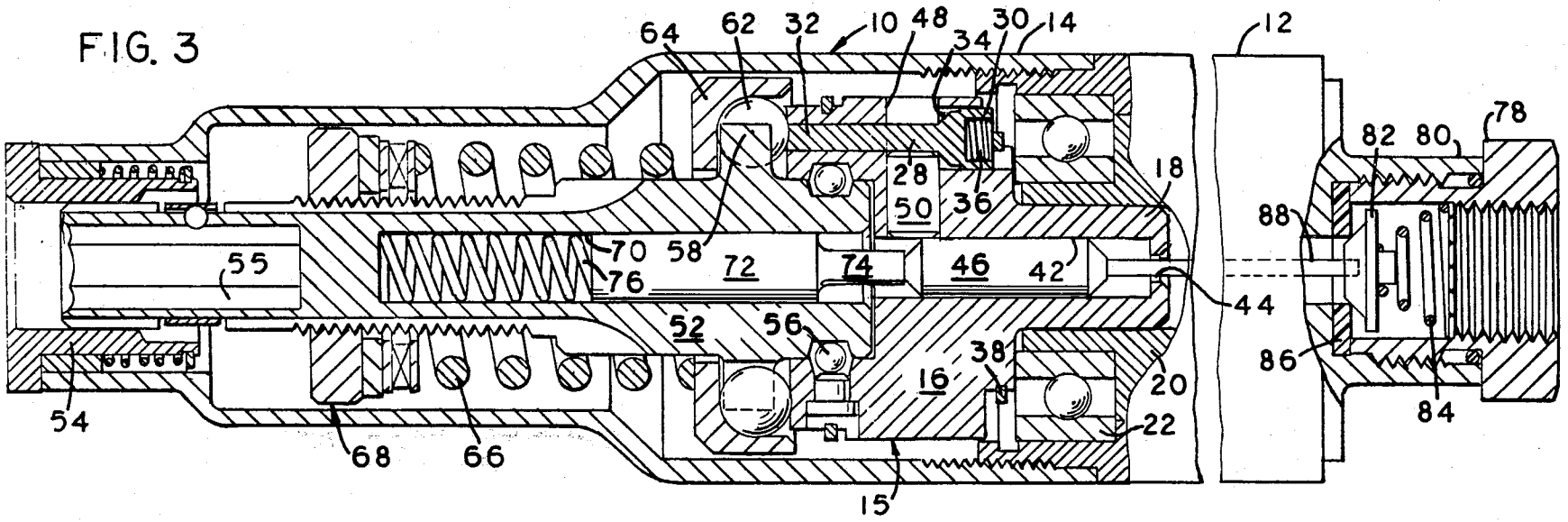
FIG. 3 is the same but showing the position of various parts of the tool at attainment of fastener pre-set torque and tool operation cut-off.
Figure 6:
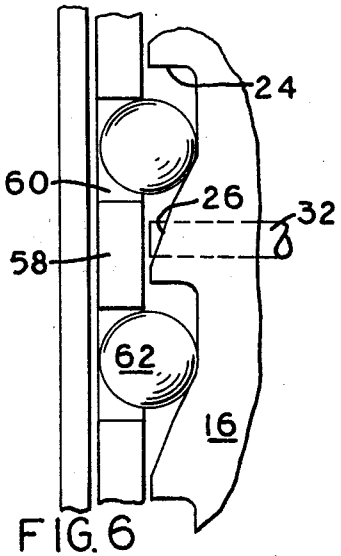

When the operator places the tool on a workpiece (not shown) the movable elements assume the relative positions illustrated in FIG. 2. In such position, it will be seen that the drive spindle 52 has been moved rearwardly causing similar movement of the clutch assemblage 15 by reason of operative connection therewith. During such movement, the lock pin 50 will engage the rod 46 and the latter will engage the push rod 88 resulting in unseating of the valve 82 and compression of the spring 84. Pressurized pneumatic medium will thus be allowed to flow into the tool motor resulting in operation thereof, and rotation of the clutch assemblage and spindle for fastener run-up. During such action, the force of spring 66 will maintain the balls 62 in the jaw pockets, as seen in FIG. 6, whereby rotary motion is transmitted to the spindle 52.

Figure 7:
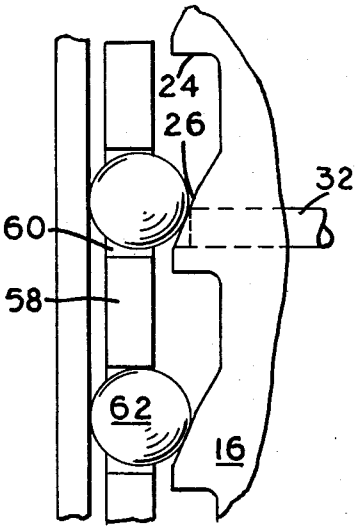
FIGS. 5, 6 and 7 are fragmentary elevation views of a ball clutch arrangement used in the tool and showing the position of various parts under the tool conditions of FIGS. 1, 2 and 3 respectively.

When the torque being applied to the fastener exceeds the pre-set compressive force of spring 66, the balls 62 will be cammed out of one pocket into the next. In so doing, the end of the latch pin 28 will be engaged as a ball rolls up the associated ball ramp 26 (FIG. 7) causing movement of the latch pin rearwardly. Such latch pin movement will free the end of the lock pin 50 from engagement with the latch pin head portion 30. The force of spring 84, acting upon the push rod 88, will cause the latter to move the rod 46 so as to cam the lock pin upwardly into engagement with the body portion 32 of the latch pin 28. The rod 46, being free of restricting engagement with the lock pin 50, will move forwardly resulting in further forward movement of the push rod 88, and allow the valve 82 to seat and shut off further flow of pneumatic medium. Tool operation is thus terminated and completion of setting action upon the workpiece is effected.

When the operator removes the tool from the workpiece, spring 76 moves the spindle and clutch assembly forward in the clutch housing relative to pins 74 and 46. When this movement is sufficient for pin 50 to clear pin 46, spring 36 will cam the pin 50 downward into engagement with reset pin reduced diameter portion 74, and the movable elements will return to tool non-operative condition (FIG. 1). The tool is now ready for start of another work operation.

While an embodiment of the invention has been illustrated and described in detail, it is to be expressly understood that the invention is not limited thereto. Various changes in form, design or arrangement may be made in its parts without departing from the spirit and scope of the invention; it is my intention, therefore, to claim the invention not only as shown and described, but also in all such forms and modifications thereof as might be reasonably construed to be within the spirit of the invention and the scope of the appended claims.

I claim:

1. In a pneumatically powered screwdriver, a motor housing, a clutch housing affixed to the motor housing, a valve movable to control flow of pneumatic fluid to the motor housing for operation of a rotary motor therein, a push rod for unseating of the valve to allow flow of pneumatic fluid to the motor, a valve spring which is biased to seat the valve to shut off flow of pneumatic fluid to the motor, a clutch member in the clutch housing and rotatably driven by the motor, a spindle in the clutch housing adapted for receipt of a tool bit shank, a plurality of balls arranged to convey rotary motion from the clutch member to the spindle, and a ball compression means urging the balls into engagement with the clutch member, a torque responsive shut-off means for the screwdriver comprising: movable means slidingly supported in the spindle and clutch member, compression means biasing said movable means into engagement with the push rod for unseating of the valve, a latch pin arranged in the clutch member, a spring biased for movement of the latch pin into the path of movement of one of said balls, and a lock pin arranged in the clutch member between the latch pin and the movable means for preventing sliding movement of said movable means, said lock pin responsive to movement of said latch pin caused by said one of said balls to release said movable means for sliding movement to enable said valve spring to overcome the bias of said compression means and seat said valve is seated.

2. In a pneumatically powered screwdriver according to claim 1, wherein said clutch member and said spindle are movable as a unit in the direction of the motor housing when the end of the spindle is forced against a workpiece.

3. In a pneumatically powered screwdriver according to claim 1, wherein said clutch member has ball pockets each having a ball ramp which a ball is forced to traverse when a predetermined rotational resistance is imposed upon the spindle, an end of said latch pin being arranged to extend beyond the ramp of an associated ball pocket prior to tool shut-off operation.

4. In a pneumatically powered screwdriver according to claim 3, wherein said latch pin has a body portion which is engageable by the lock pin, an enlarged head portion integral with the body portion, and a cam surface between said body portion and head portion, which cam surface is effective to cam the lock pin away from engagement with the body portion.

5. In a pneumatically powered screwdriver according to claim 4, wherein said movable means comprises a reset pin having a reduced diameter portion, and a cylindrical rod interposed between the reset pin and the push rod, said reduced diameter portion being arranged for engagement by the lock pin.

6. In a pneumatically powered screwdriver according to claim 5, wherein the valve spring is effective to move the cylindrical rod to cause the lock pin to move into engagement with the body portion of the latch pin when the latch pin is moved in response to a ball moving over the end thereof.

7. In a pneumatically powered screwdriver according to claim 6, wherein the reset pin is maintained in engagement with the lock pin by force maintained upon the cylindrical rod under bias of the valve spring.

* * * * *